US007017231B2

(12) United States Patent
Isele

(10) Patent No.: US 7,017,231 B2
(45) Date of Patent: Mar. 28, 2006

(54) HINGE

(75) Inventor: Herbert Isele, Lustenau (AT)

(73) Assignee: Julius Blum Gesellschaft m.b.H., Industriestrasse (AT)

( * ) Notice: Subject to any disclaimer, the term of this patent is extended or adjusted under 35 U.S.C. 154(b) by 0 days.

(21) Appl. No.: 10/423,902

(22) Filed: Apr. 28, 2003

(65) Prior Publication Data

US 2004/0163213 A1 Aug. 26, 2004

(30) Foreign Application Priority Data

Feb. 21, 2003 (AT) ..... GM107/2003

(51) Int. Cl.
*E05D 7/04* (2006.01)

(52) U.S. Cl. ..... 16/242; 16/382; 16/246; 16/243; 16/236

(58) Field of Classification Search ..... 16/242, 16/240, 245, 238, 235, 236, 243, 246, 382
See application file for complete search history.

(56) References Cited

U.S. PATENT DOCUMENTS

| | | | | | |
|---|---|---|---|---|---|
| 3,890,670 | A * | 6/1975 | Sewing et al. | ..... | 16/236 |
| 4,359,802 | A * | 11/1982 | Rock | ..... | 16/238 |
| 5,245,727 | A * | 9/1993 | Sasaki | ..... | 16/258 |
| 5,603,142 | A * | 2/1997 | Dubach et al. | ..... | 16/247 |
| 5,621,947 | A * | 4/1997 | Fitz et al. | ..... | 16/249 |
| 5,737,804 | A * | 4/1998 | Ferrari et al. | ..... | 16/242 |
| 5,964,010 | A * | 10/1999 | Huber | ..... | 16/237 |
| 6,032,333 | A * | 3/2000 | Brustle | ..... | 16/242 |
| 6,266,848 | B1 * | 7/2001 | Fraccaro et al. | ..... | 16/245 |
| 6,578,232 | B1 * | 6/2003 | Salice | ..... | 16/235 |
| 6,615,452 | B1 * | 9/2003 | Mueller et al. | ..... | 16/242 |
| 6,622,343 | B1 * | 9/2003 | Rupprechter | ..... | 16/242 |
| 6,643,895 | B1 * | 11/2003 | Domenig et al. | ..... | 16/238 |
| 6,647,591 | B1 * | 11/2003 | Domenig et al. | ..... | 16/242 |
| 6,757,939 | B1 * | 7/2004 | Mueller et al. | ..... | 16/242 |
| 6,845,544 | B1 * | 1/2005 | Hofer | ..... | 16/246 |

FOREIGN PATENT DOCUMENTS

| | | | |
|---|---|---|---|
| DE | 4016664 | A * | 11/1991 |
| EP | 790378 | A1 * | 8/1997 |
| EP | 982455 | A2 * | 3/2000 |
| EP | 1167670 | A2 | 1/2002 |
| EP | 1236853 | A2 | 9/2002 |
| EP | 1367203 | A2 * | 12/2003 |
| JP | 2002004694 | A * | 1/2002 |
| WO | 97/22773 | | 6/1997 |

* cited by examiner

*Primary Examiner*—Chuck Y. Mah
(74) *Attorney, Agent, or Firm*—Wenderoth, Lind & Ponack, L.L.P.

(57) ABSTRACT

A hinge is to be used for a piece of furniture with a frame and with a door wing secured to the frame. The hinge has a bedplate to be fitted to the frame, which bedplate carries an intermediate piece and a hinge arm. Furthermore, a joint-adjustment screw and a device for the depth adjustment of the hinge arm are provided. In one of the bedplate, intermediate piece, and hinge arm, a rotatable part is housed for the height adjustment of the hinge arm relative to the bedplate. The intermediate part and/or the hinge arm is able to be moved relative to the bedplate via the rotatable part.

11 Claims, 9 Drawing Sheets

HINGE

BACKGROUND OF THE INVENTION

The invention relates to a hinge for furniture with a frame and with a door wing secured to the frame. The hinge includes a bedplate which is to be fitted to the frame and which carries an intermediate piece and a hinge arm, a joint-adjustment screw, and a device for the depth adjustment of the hinge arm.

In modern furniture construction, so-called door frames are sometimes used. These frames, as a stable part of the item of furniture, carry the hinges for the door wings, while the actual side walls of the body of the furniture are made from weaker material. This brings with it the advantage that either the overall costs of the item of furniture can be reduced, or higher-quality and thus optically more attractive materials can be chosen for the side walls without the item of furniture being more expensive as compared with furniture produced by conventional means.

Such a hinge is known, for example, from the Austrian utility model AT 1385 U1.

In the case of such hinges, it is known to provide the bedplate with an oblong hole aligned vertically in a mounting position, in order to make possible a height adjustment of the door wing. For this, however, the fixing screw must be loosened and the door wing raised or lowered together with the hinges attached to it. Once the height positioning has taken place, the fixing screws of the hinges must be tightened again. In particular, in the case of larger and heavier door wings, it is difficult to find the right height position for the door wing.

SUMMARY OF THE INVENTION

The object of the invention is to improve a hinge of the type mentioned at the outset such that a more comfortable height adjustment of the door wing is made possible.

The object according to the invention is achieved in that, for the height adjustment of the hinge arm relative to the bedplate, one of the bedplate, an intermediate piece, and a hinge arm has a rotatable part housed so that the intermediate piece and/or the hinge arm can be shifted relative to the bedplate.

The rotatable part can, for example, be designed as an eccentric or as an annular disk which has, on one side, a bar running in the form of a spiral against which at least one projection of a hinge part, such as bedplate, intermediate piece, or hinge arm, rests. By way of example, the rotatable disk is held in the intermediate piece and the projections are provided at the bedplate. Upon turning of the disk, the intermediate piece is shifted together with the hinge arm relative to the bedplate.

An embodiment of the invention provides that the bedplate, the intermediate piece and the hinge arm are connected by a pin aligned parallel to the axis of rotation of the hinge, and that the hinge arm can be shifted on the pin in its longitudinal direction. The joint-adjustment screw has, in a manner known per se, a threaded section, a neck and a head, and the neck projects through an oblong hole in the bedplate, which hole is aligned parallel to the axis of rotation of the hinge.

According to another embodiment of the invention, the disk has, at the seat for the adjustment tool, a cylindrical base which is accommodated in a circular recess of the intermediate piece.

Another embodiment of the invention provides that the disk has, at the seat for the adjustment tool, a cylindrical base which is accommodated in a circular recess of the hinge arm. In this case, the projections are developed at the intermediate piece and, upon adjustment, the hinge arm is moved relative to the intermediate piece in the height of the item of furniture.

BRIEF DESCRIPTION OF THE DRAWINGS

Various embodiments of the invention are described below with reference to the figures of the attached drawings, wherein.

DETAILED DESCRIPTION OF THE PREFERRED EMBODIMENTS

Figure 1:
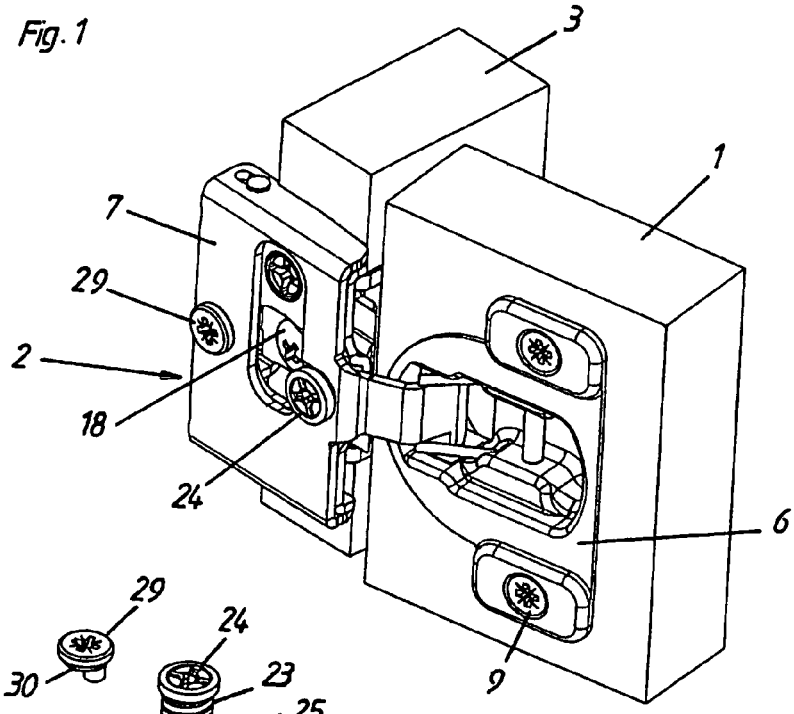
FIG. 1 is a perspective view of a hinge according to the invention in the mounting position, wherein sections of the frame and of the door wing are shown.

In FIG. 1, a door wing 1 is shown in the open position. The hinge 2 connects the door wing 1 to the frame 3 of the body of the item of furniture.

In the embodiment according to FIGS. 1 to 16, the hinge 2 consists of the bedplate 5, an intermediate piece 4, a hinge arm 7, and a hinge casing 6 on the door wing side. The hinge arm 7 is housed on the intermediate piece 4, and the intermediate piece 4 is housed on the bedplate 5. The hinge casing 6 is articulated to the hinge arm 7 by means of a hinge axle. The hinge axle is formed by a first leg 11 of a U-stirrup 8. The hinge casing 6 is inserted into a bore in the door wing 1 in a mounting position, and is screwed to the door wing 1 by means of screws 9.

Two legged springs 13, which exert a closure force, are housed at the hinge casing 6. The legged springs 13 are housed on a second leg 11' of the U-stirrup 8.

The legs 12 of the legged springs 13 press on a control part 14 at the free end of the hinge arm 7. The hinge casing 6 is held in the closure position by the legged springs 13, or pulled into the closure position if the angle between the door wing 1 and the closure plane is very small.

The bedplate 5 is housed directly against the frame 3 and is screwed to the frame 3 by means of a fixing screw 18 which projects through a hole 15 of the bedplate 5. On the side facing the open door wing 1, the bedplate 5 has two angled lugs 16 which rest against the frame 3 at the front in the mounting position. At the rear of the frame 3, the bedplate 5 is also provided with a lug which rests against the frame 3 at the back.

Both the intermediate piece 4 and the hinge arm 7 are developed with a U-shaped cross-section. In the rear region, the bedplate 5 has two upwardly bent butts 17 which project into the intermediate piece 4. The side bars 4' of the intermediate piece 4 and the side bars 7' of the hinge arm 7 point towards the bedplate 5. The upwardly bent butts 17 of the bedplate 5 are provided with holes 19 which are designed as bores or punched holes. The side bars 4' of the intermediate piece 4 also have circular holes 20, and the side bars 7' of the hinge arm 7 have oblong holes 21. The intermediate piece 4 and the hinge arm 7 are connected to the bedplate 5 by means of a pin 22 which projects through the holes 19, 20, 21.

Housed in a rear opening 28 of the intermediate piece 4 is an eccentric (moving component) 29, the eccentric cam 30 of which is arranged within an oblong hole 31 of the hinge arm 7. Through turning of the eccentric 29, the position of the hinge arm 7 with respect to intermediate piece 4 can be adjusted over the length of the oblong holes 21, so as to allow the hinge arm 7 to move in the direction of the depth of the item of furniture.

If the position of the door wing 1 is to be adjusted in the direction of the furniture joint, the joint-adjustment screw 24 is turned so that the hinge arm 7 is tilted about the pin 22. The joint-adjustment screw 24 has a threaded section 23, a neck 25 and a head 26. The bedplate 5 is provided with an oblong hole 27, the intermediate piece 4 has a circular hole 32, and the hinge arm 7 has an oblong hole 33, open to the rear, which opens into a further oblong hole 34. The joint-adjustment screw 24 projects with its neck 25 through the circular hole 32 in the intermediate piece 4 and the oblong hole 27 in the bedplate 5, and is riveted with its head 26 beneath the bedplate 5.

The opposite-facing rims 35 of the oblong hole 33 engage in the thread of the threaded section 23 of the joint-adjustment screw 24. In order to facilitate this engagement, the rims 35 are offset in the direction of the length of the joint-adjustment screw over the height of a thread pitch. Because the joint-adjustment screw 24 is accommodated with its threaded section 23 in the oblong hole 33, the depth adjustment of the hinge arm 7 is not impeded by the joint-adjustment screw 24.

The oblong hole 34 makes possible the suspension of the joint-adjustment screw 24 into the oblong hole 33. The oblong hole 34 also allows access for an adjustment tool to the fixing screw 18 and to a spiral disk (rotatable part) 10, which serves as the height adjustment device of the hinge arm 7. The spiral disk 10 has, at its side facing the bedplate 5, a spiral projecting bar 36. The projecting bar 36 lies against projections 37 of the bedplate 5 in the mounting position. On its side lying opposite the spiral projection 36, the spiral disk 10 has a cylindrical base 38 which is accommodated in a circular recess 47 of the intermediate piece 4. A seat for an adjustment tool, preferably for a Phillips turnscrew, is located in the base 38.

Figure 2:
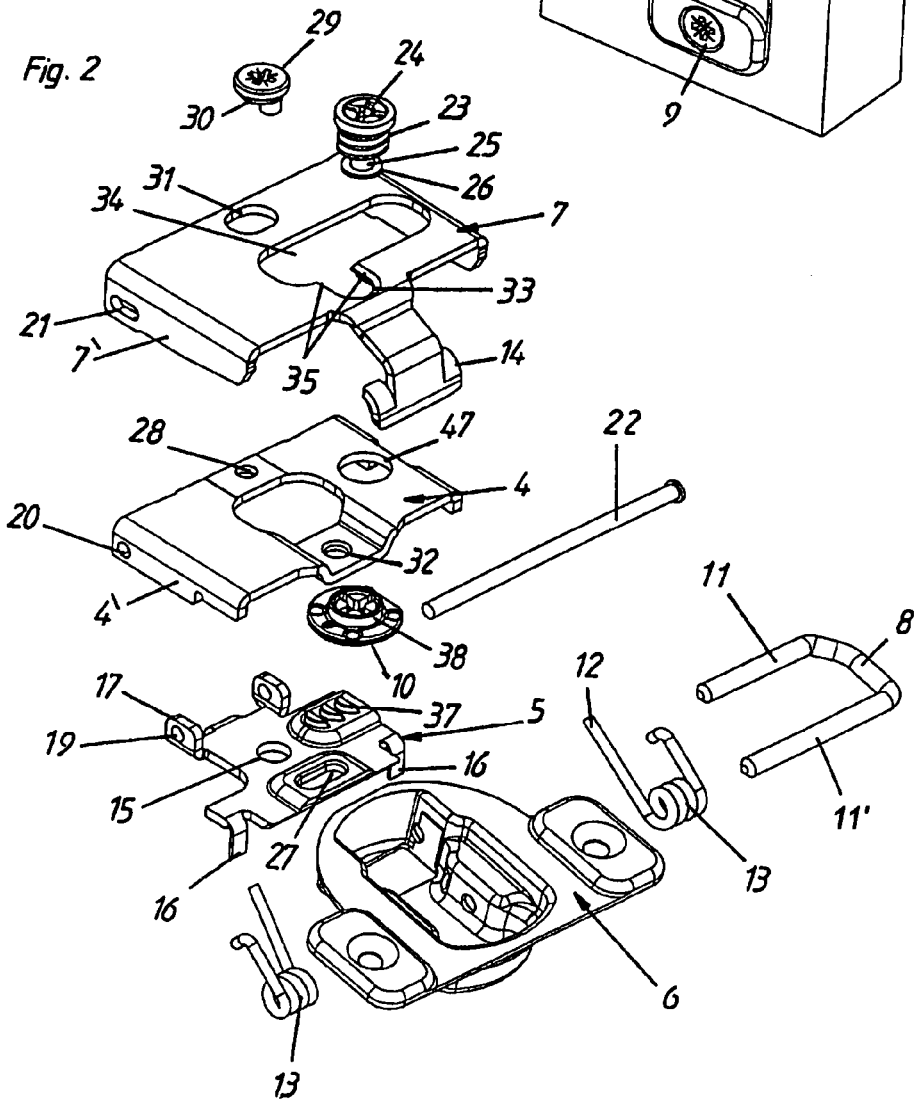
FIG. 2 is an exploded perspective view of a hinge.
Figure 3:
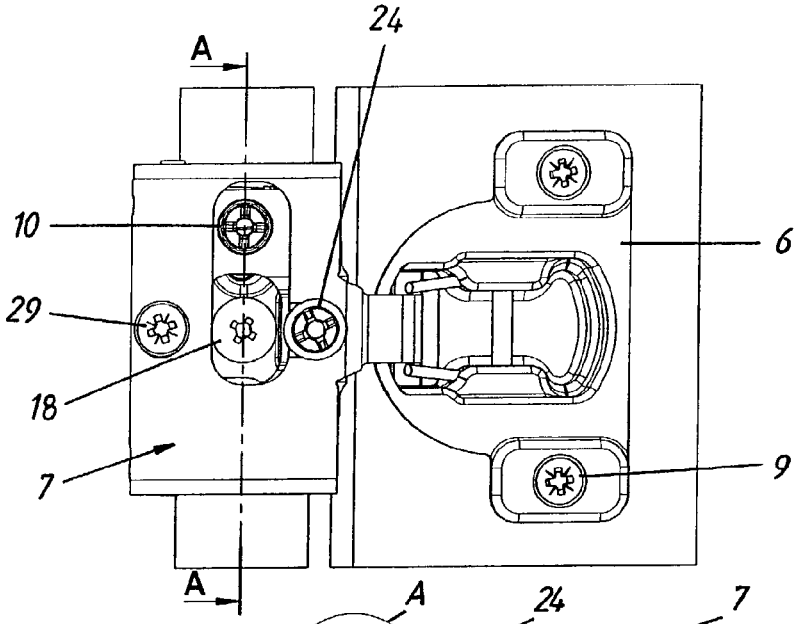
FIG. 3 is a top view of a hinge according to the invention.
Figure 4:
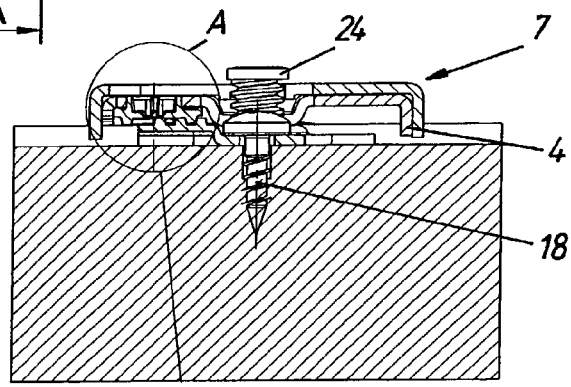
FIG. 4 is a section along the line A—A of FIG. 3.
Figure 5:
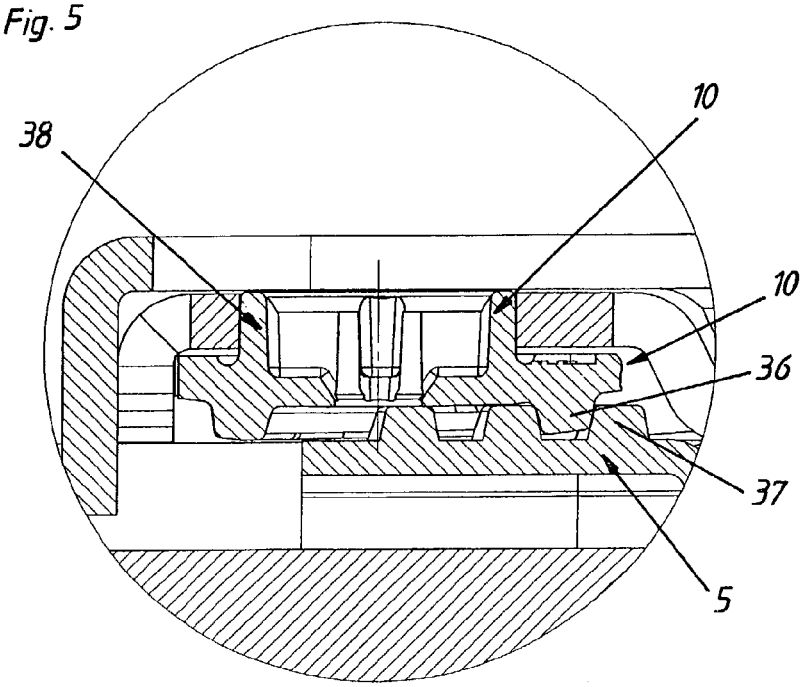
FIG. 5 is the cut-out section A of FIG. 4 on an enlarged scale.
Figure 6:
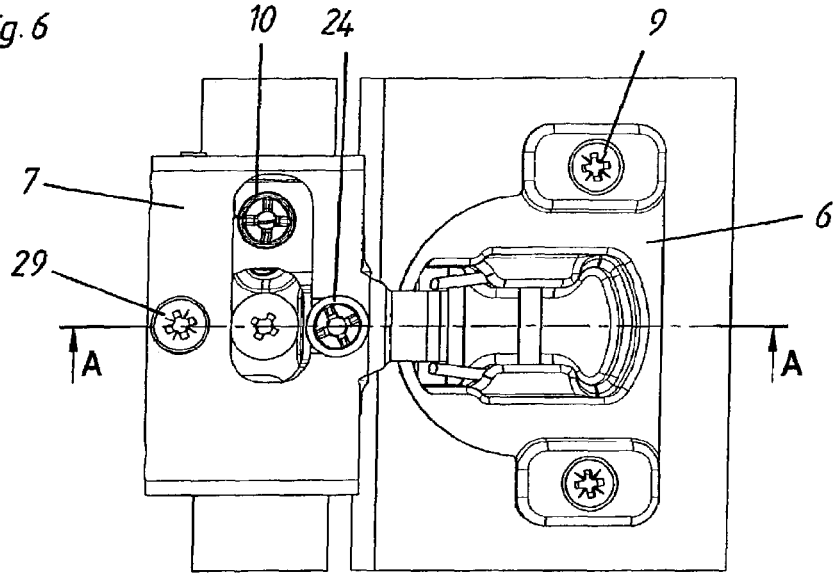
FIG. 6 is a top view of a hinge according to the invention.
Figure 7:
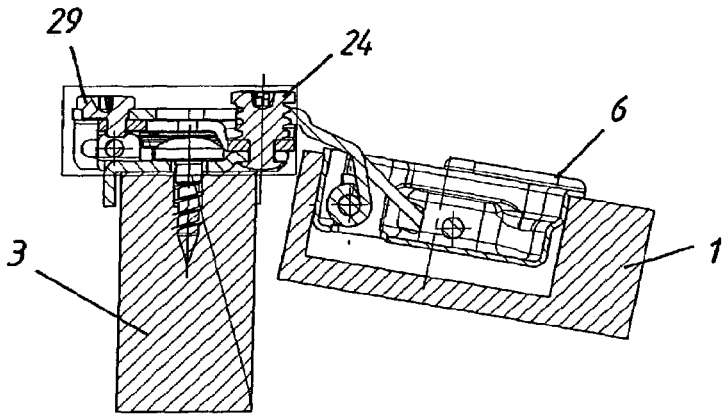
FIG. 7 is a section along the line A—A of FIG. 6.
Figure 8:
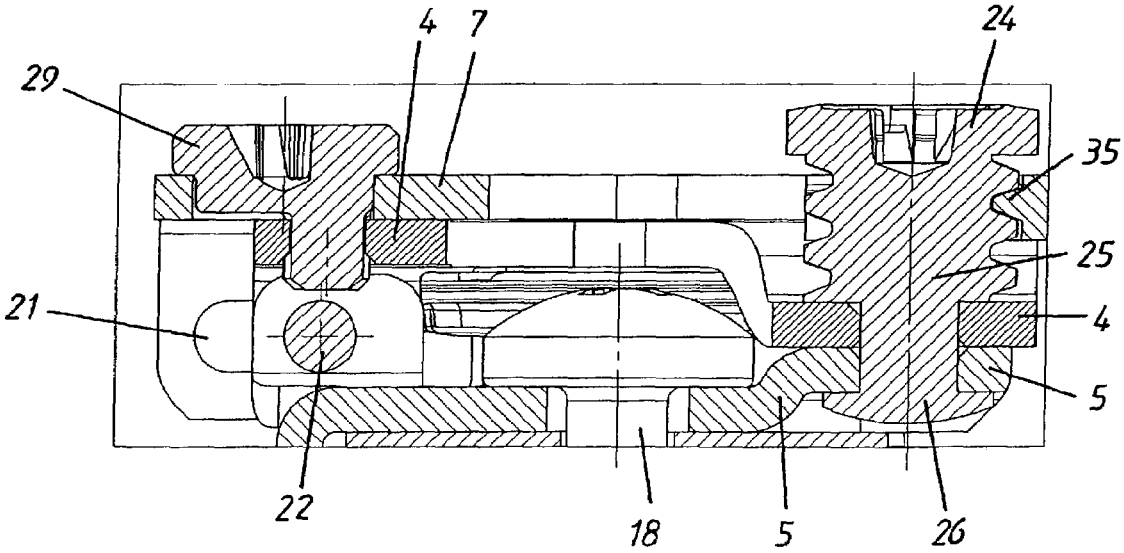
FIG. 8 is a section through the hinge arm, the intermediate piece, and the bedplate along the line A—A of FIG. 6 on an enlarged scale.
Figure 9:
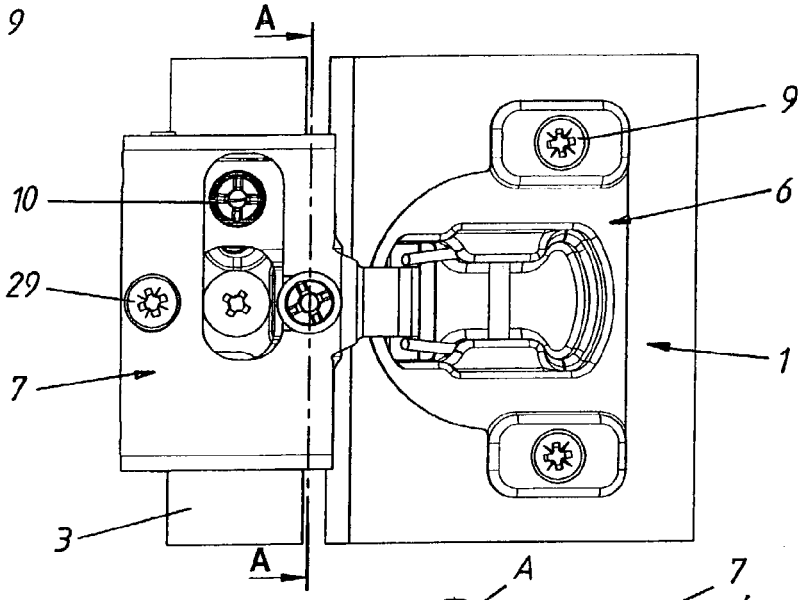
FIG. 9 is a top view of a hinge according to the invention.
Figure 10:
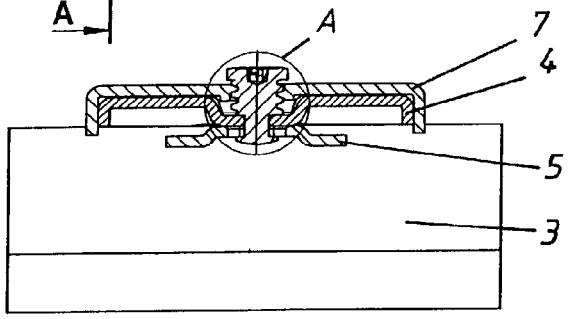
FIG. 10 is a section along the line A—A of FIG. 9.
Figure 11:
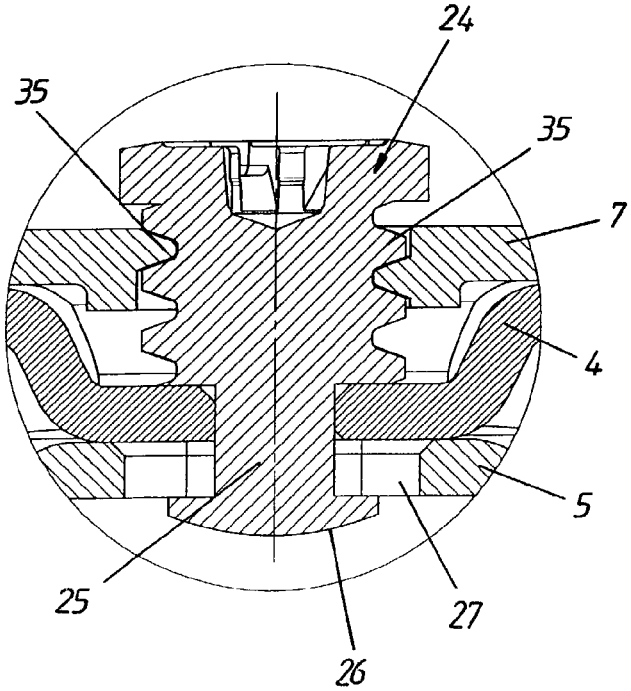
FIG. 11 is the cut-out section A of FIG. 10.
Figure 12:
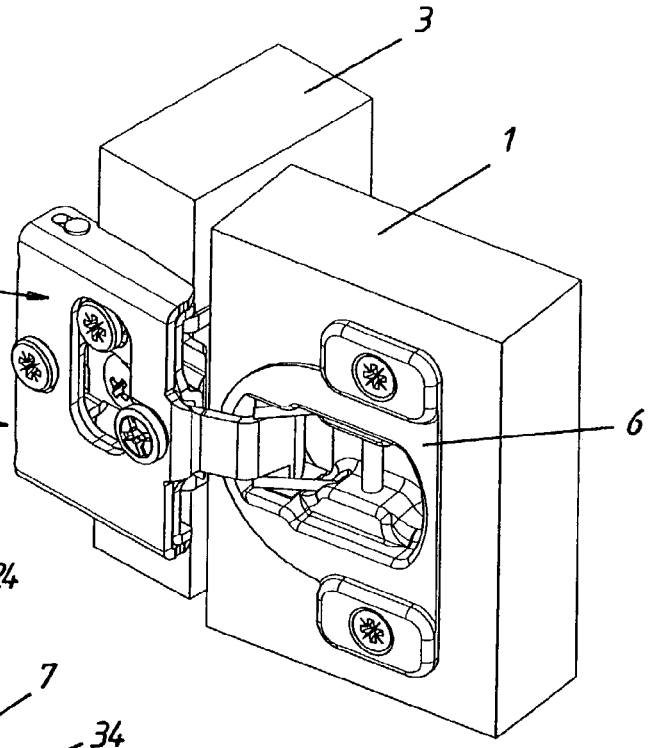
FIG. 12 is a perspective view of another embodiment of a hinge according to the invention in the mounting position, wherein sections of the frame and of the door wing are shown.
Figure 13:
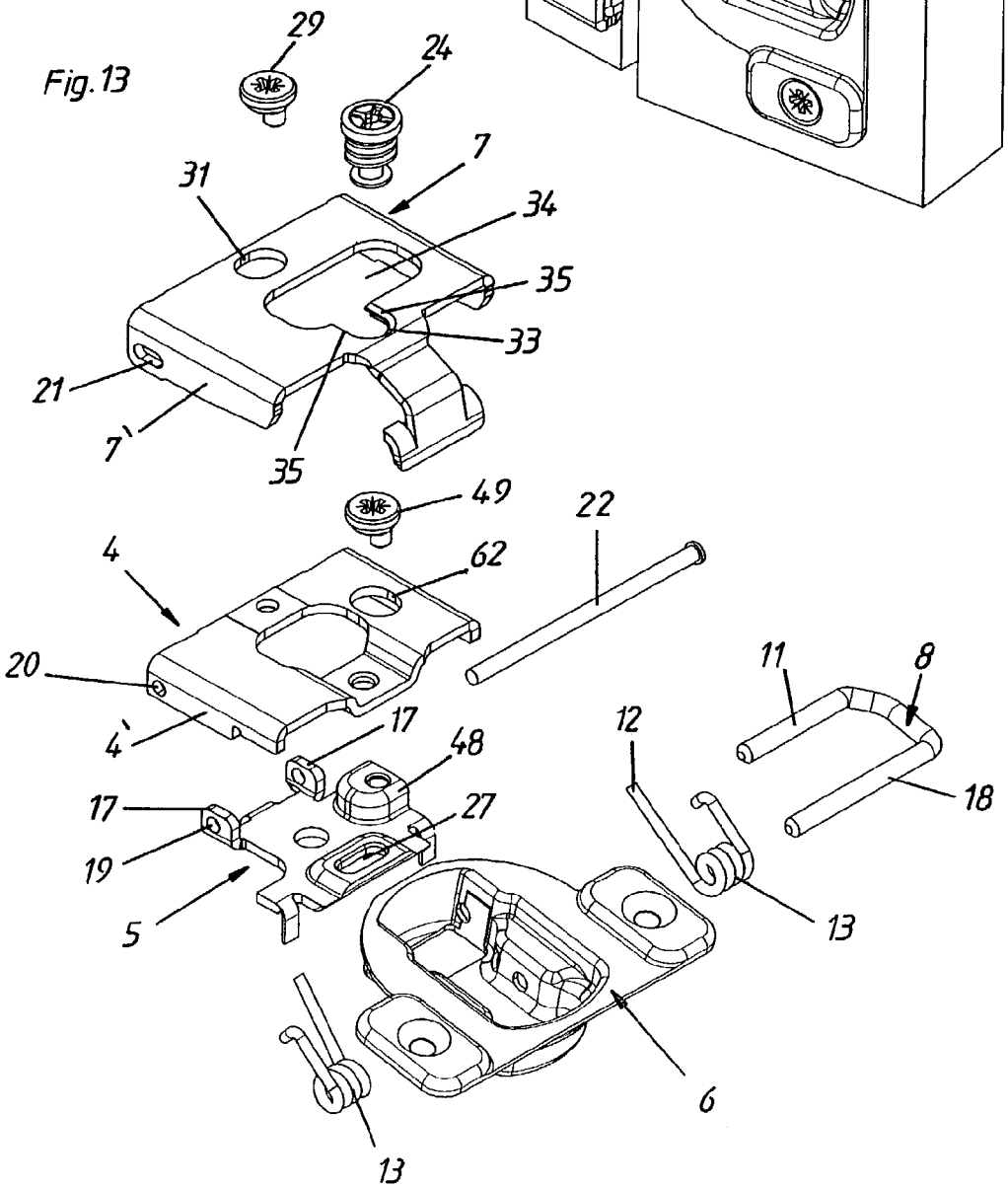
FIG. 13 is an exploded perspective view of a hinge according to this embodiment.
Figure 14:
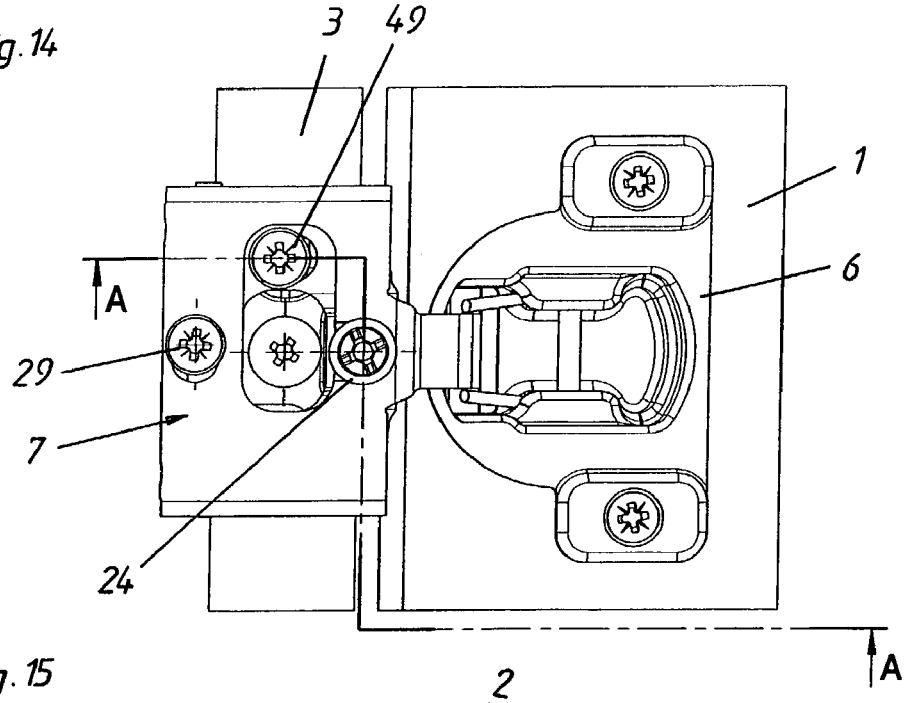
FIG. 14 is a top view of a hinge according to the embodiment of FIGS. 12 and 13.
Figure 15:
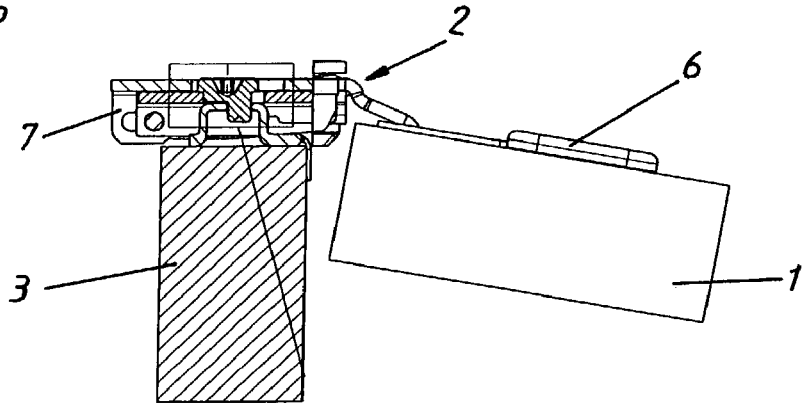
FIG. 15 is a section along the line A—A of FIG. 14.
Figure 16:
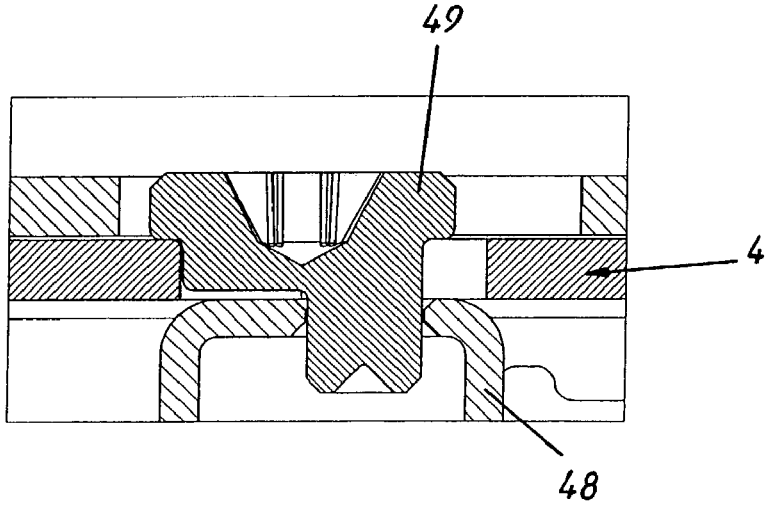
FIG. 16 is a section in the region of the eccentric for the height adjustment on an enlarged scale.

The height adjustment of the hinge arm 7 and thus of the door wing 1 takes place simply by turning of the spiral disk 10. No clamping screw needs to be loosened and then re-tightened. Because the spiral projection 36 is developed in a self-locking manner, the door wing 1 is also prevented from dropping. Through turning of the spiral disk 10, the intermediate piece 4 is shifted together with the hinge arm 7 relative to bedplate 5 in a direction parallel to the pin 22 on the hinge arm. As illustrated by FIG. 2, the pin 22 is parallel to the first leg (hinge axle) 11, so that the rotation of spiral disk 10 shifts the hinge arm 7 in a direction that is also parallel to first leg (hinge axle 11). This adjustment movement can be followed by adjustment of the joint-adjustment screw 24 within the oblong hole 27 of the bedplate 5.

In the embodiment according to FIGS. 12 to 16, the height adjustment of the hinge arm 7 takes place through an eccentric 49. The hinge casing 6 and its connection to the hinge arm 7, as well as the closure mechanism, are developed in the same way as in the case of the previously-described embodiment, for which reason these parts of the hinge 2 will not be discussed again.

The hinge arm 7 is also developed in the same way as in the case of the previously described embodiment. The only difference compared with the previously-described embodiment is that the bedplate 5 has a base 48 in which the eccentric 49 is housed. The eccentric 49 projects into an oblong hole 62 in the intermediate piece 4, so that its eccentric cam is accommodated in the oblong hole 62.

Through turning of the eccentric 49, the intermediate piece 4 moves together with the hinge arm 7 in the direction of the height of the item of furniture.

The joint-adjustment screw 24 and its anchorage in the bedplate 5, in the intermediate piece 4 and in the hinge arm 7 is the same as in the previously described embodiment.

The depth adjustment of the hinge arm 7 takes place as in the case of the previously described embodiment by means of the eccentric 29.

Figure 17:
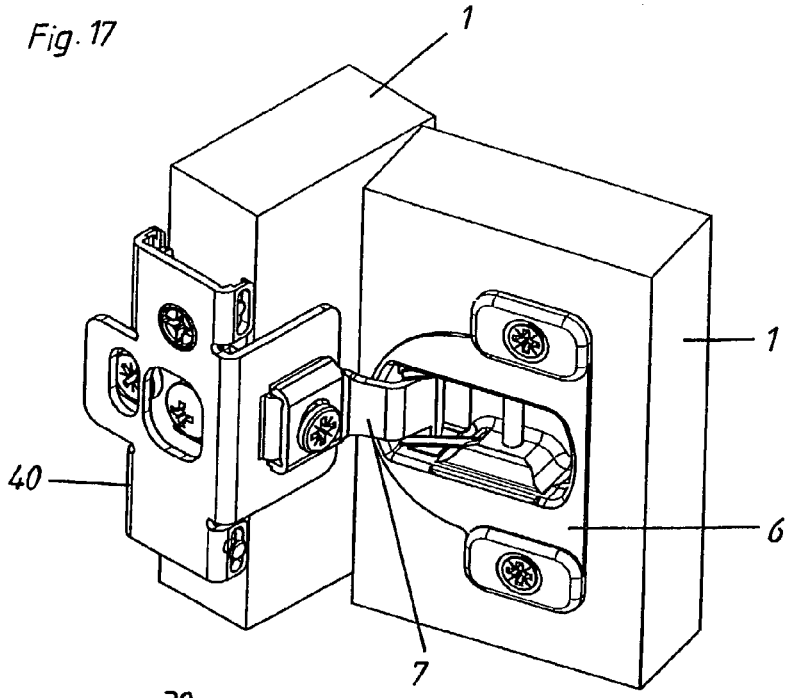
FIG. 17 is a perspective view of another embodiment of a hinge according to the invention.
Figure 18:
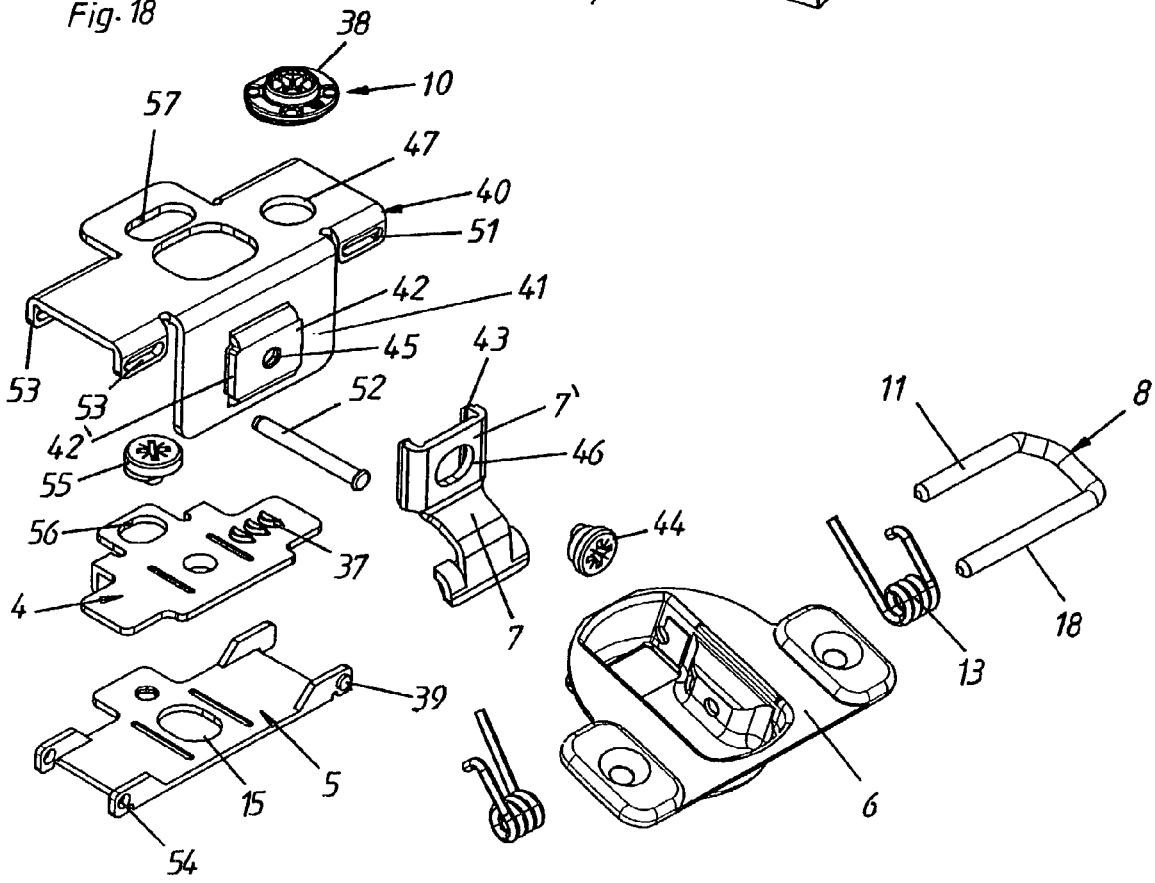
FIG. 18 is a top view of a hinge according to FIG. 17.
Figure 21:
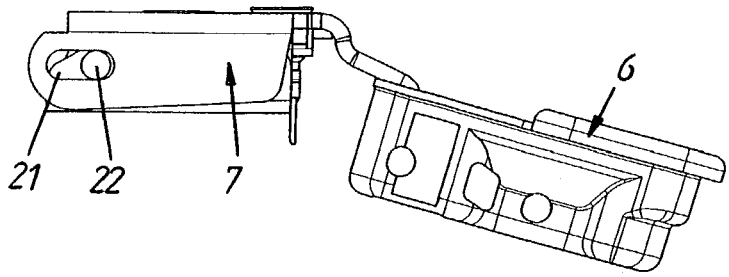
FIG. 21 is a perspective view of another embodiment of a hinge according to the invention in the mounting position, wherein sections of the frame and of the door wing are shown.
Figure 20:
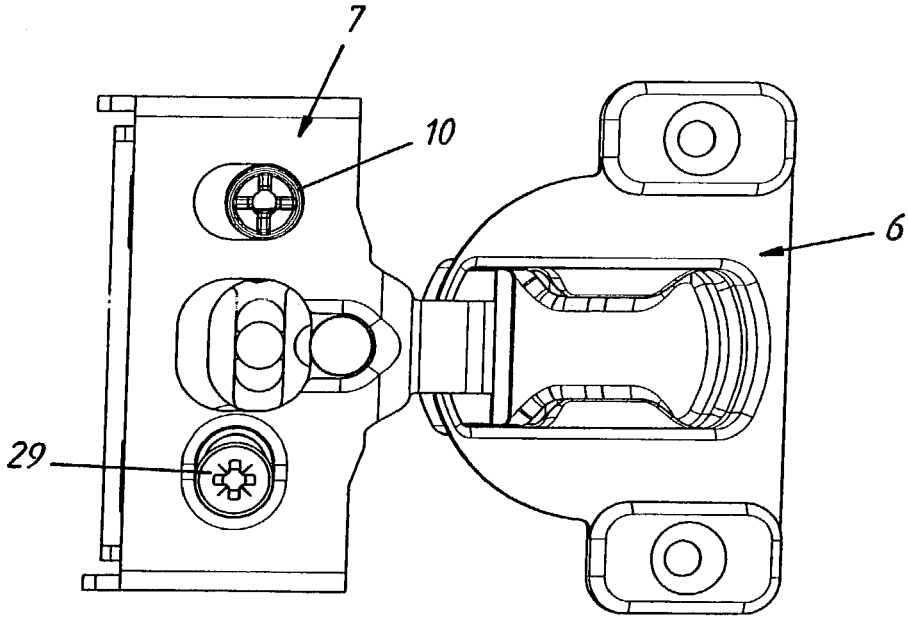
FIG. 20 is an exploded perspective view of a hinge according to the embodiment of FIGS. 17 to 19.
Figure 19:
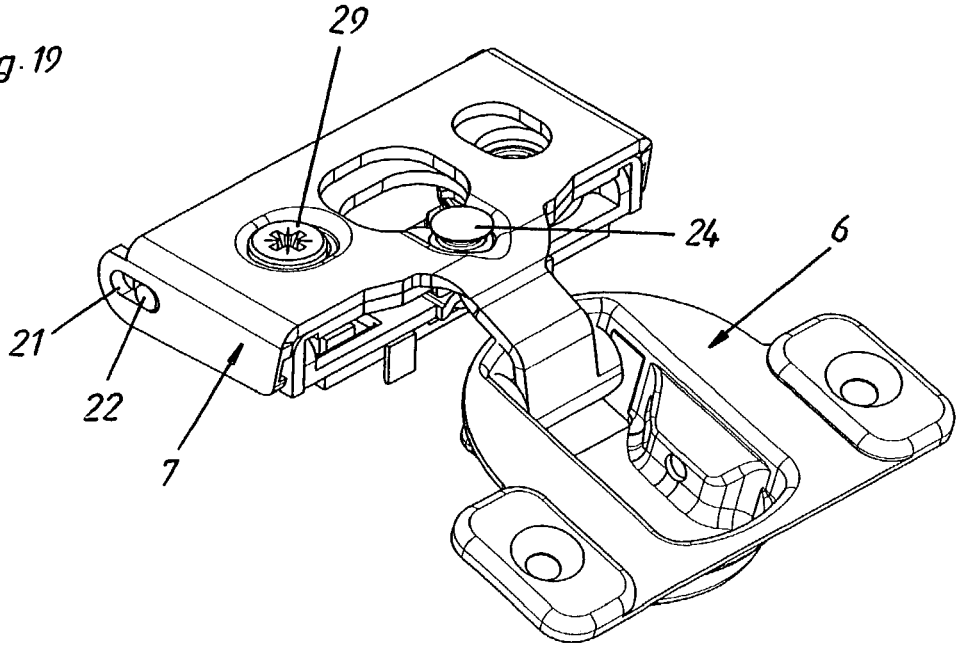
FIG. 19 is a side view of a hinge according to FIG. 17.
Figure 22:
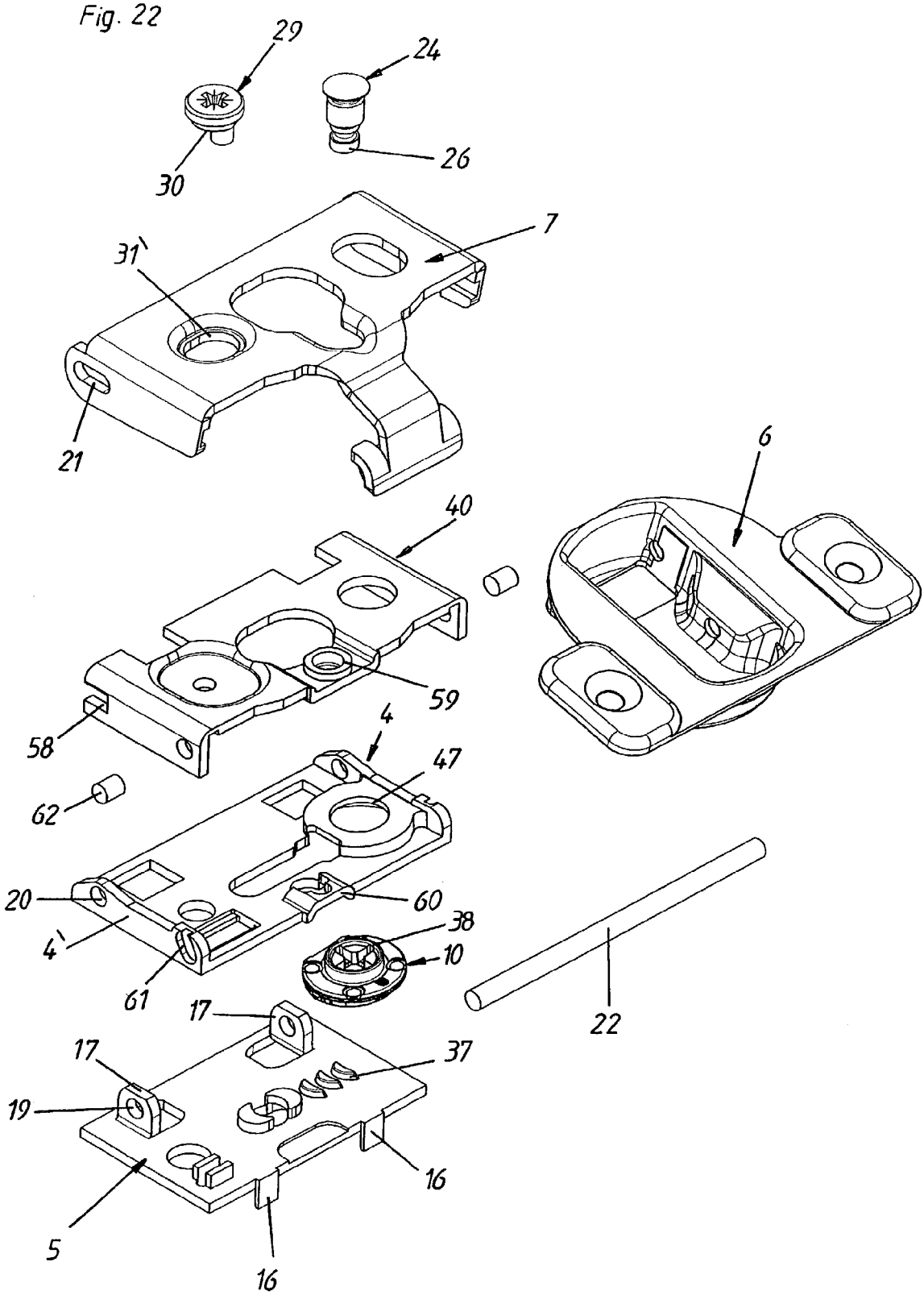
FIG. 22 is an exploded perspective view of a hinge according to the embodiment of FIG. 21.

In the embodiment according to FIGS. 17 and 18, the hinge arm 7 is housed on a second intermediate piece 40. The hinge 2 thus has the following structure: bedplate 5, first intermediate piece 4, second intermediate piece 40, hinge arm 7, and hinge casing 6. The housing of the hinge casing 6 at the hinge arm 7 as well as the closure mechanism are developed in the same way as in the case of the previously described embodiments.

The bedplate 5 and the two intermediate pieces 4, 40 are preferably made from sheet steel. The bedplate 5 has a hole 15 through which a fixing screw 18 projects by means of which the bedplate 5 is secured to the furniture frame 1.

The intermediate piece 40 is designed so as to be L-shaped. A stirrup 42, which extends in the longitudinal direction of the hinge arm 7, is punched out from the bar 41, resting against the front side of the frame 3, of the intermediate piece 40. The hinge arm 7 is pushed up onto this stirrup 42 and is thus anchored to the intermediate piece 40.

The stirrup 42 is punched out from the intermediate piece 40 in such a way that it has laterally projecting edge projections 42'. The hinge arm 7 has a C-shaped region 7' with inwardly directed projections 43. When the hinge arm 7 is shifted onto the stirrup 42, the projections 43 of the hinge arm 7 engage behind the edge projections 42' of the stirrup 42.

The adjustment of the hinge arm 7 in the direction of the furniture door joint takes place by means of an eccentric 44 which is housed so as to be rotatable with a journal in a hole 45 of the stirrup 42.

The hinge arm 7 is again provided with an oblong hole 46 which is aligned transverse to the hinge arm 7. The eccentric cam of the eccentric 44 is accommodated in the oblong hole 46 when in the mounting position. The eccentric 44 is riveted with its journal in the stirrup 42, and has a head which rests against the stirrup 42 outside. Through this design, the hinge arm 7 is held so that it cannot be lost at the first intermediate piece 4.

The second intermediate piece 40 again has a circular recess 47 in which a base 38 of the spiral disk 10 is accommodated. The spiral projection 36 of the spiral disk 10 lies against projections 37 of the intermediate piece 4. Through turning of the spiral disk 10, the second intermediate piece 40 and thus the hinge arm 7 can be adjusted in the direction of the height of the item of furniture.

The intermediate piece 40 is guided on one side by journals 39 on the bedplate 5 and which project into oblong holes 51 of the intermediate piece, and on the other by a connecting pin 52 which is housed in holes 54 of the bedplate 5 and projects through oblong holes 53 in the intermediate piece 40.

An eccentric 55, the eccentric cam of which is accommodated in an oblong hole 56 of the intermediate piece 4, is housed in the bedplate 5.

Through turning of the eccentric 55, the first intermediate piece 4 together with the second intermediate piece 40 and the hinge arm 7 can be adjusted in the direction of the depth of the item of furniture. An oblong hole 57 in the intermediate piece 40 allows access of a screwdriver to the eccentric 55.

In the embodiment according to FIGS. 19 to 22, the hinge 2 again has two intermediate pieces 4 and 40.

The bedplate 5, the first intermediate piece 4, the second intermediate piece 40, and the hinge arm 7 are connected to each other by a pin 22. The pin 22 projects through oblong holes 21 in the hinge arm 7, slits 58, open to the rear, in the intermediate piece 40, circular holes 20 in the side bars 4' of the intermediate piece 4, and circular holes 19 in the upwardly bent butts 17 of the bedplate 5.

The spiral disk 10 is accommodated with its cylindrical base 38 in a circular opening 47 of the first intermediate piece 4. Its spiral bar 36 (see FIG. 5) lies against projections 37 of the bedplate 5. Through turning of the spiral disk 10, the first intermediate piece 4 together with the second intermediate piece 40 and the hinge arm 7 is shifted in the direction of the height of the item of furniture.

The adjustment of the hinge arm 7 in the direction of the depth of the item of furniture again takes place through an eccentric 29 which is housed in the intermediate piece 40. The eccentric cam 30 of the eccentric 29 is accommodated in an oblong hole 31 of the hinge arm 7.

The joint-adjustment screw 24 is housed in a nut thread 59 of the intermediate piece 40, and is anchored with its head 26 in a stirrup 60 of the intermediate piece 4. Through turning of the joint-adjustment screw 24, the second intermediate piece 40 together with the hinge arm 7 is tilted relative to the first intermediate piece 4 and to the bedplate 5 about the axle formed by the pin 22.

In order that, during the joint adjustment, the position of the hinge axle is not changed in the direction of the depth of the item of furniture, the intermediate piece 4 has grooves 61, running diagonally in its side bars 4', in which journals 62 housed in side bars 40' of the second intermediate piece 40 engage. Because of the diagonal running of the grooves 61 and the journals 62, upon turning of the adjustment screw 24, the intermediate piece 40 together with the hinge arm 7 is simultaneously shifted in the direction of the depth of the item of furniture, as a result of which the swivelling of the hinge axle during the joint adjustment is again balanced out.

The invention claimed is:

1. A hinge for an item of furniture having a frame and a door wing, comprising:

a bedplate to be mounted to the frame, said bedplate having a gear rack with a plurality of projections, said projections being located on a base of said bedplate;

a hinge casing to be mounted to the door wing;

an intermediate piece carried by said bedplate;

a hinge arm carried by said bedplate, said hinge arm being pivotally connected to said hinge casing by a single hinge axle; and a rotatable part mounted on one of said bedplate, said intermediate piece, and said hinge arm, wherein said rotatable part is operable to move said hinge arm relative to said bedplate in a direction parallel to a longitudinal axis of said single hinge axle, wherein said rotatable part comprises a circular disk having a first side with a seat for an adjustment tool, and having a second side with a spiral-shaped bar for engaging a hinge part on said one of said bedplate, said intermediate piece, and said hinge arm.

2. The hinge of claim 1, wherein said rotatable part is operable to move said hinge arm and said intermediate piece relative to said bedplate.

3. The hinge of claim 1, wherein said first side of said circular disk comprises a cylindrical base arranged in a circular recess of said intermediate piece.

4. The hinge of claim 1, wherein said spiral-shaped bar of said circular disk engages projections of said intermediate piece.

5. The hinge of claim 1, wherein said projections comprise curved bars.

6. The hinge of claim 1, wherein said bedplate, said intermediate piece, and said hinge arm are connected by a pin aligned parallel to the longitudinal axis of said single hinge axle.

7. The hinge of claim 6, further comprising a moving component for moving said hinge arm on said pin in a direction perpendicular to a longitudinal axis of said pin.

8. A hinge for an item of furniture having a frame and a door wing, comprising:

a bedplate to be mounted to the frame;

a hinge casing to be mounted to the door wing;

an intermediate piece carried by said bedplate;

a hinge arm carried by said bedplate, said hinge arm being pivotally connected to said hinge casing by a single hinge axle;

a rotatable part mounted on one of said bedplate, said intermediate piece, and said hinge arm, wherein said rotatable part is operable to move said hinge arm relative to said bedplate in a direction parallel to a longitudinal axis of said single hinge axle; and a joint-adjustment screw for moving said hinge arm toward and away from said bedplate, said joint-adjustment screw having a threaded section, a neck section, and a head section, and being arranged so that said neck section projects through an oblong hole in said bedplate, said oblong hole being parallel to said single hinge axle.

9. The hinge of claim 8, wherein said neck section of said joint-adjustment screw is held in a circular hole of said intermediate piece.

10. The hinge of claim 8, wherein said oblong hole in said bedplate comprises a first oblong hole, said threaded section of said joint-adjustment screw being held in a second oblong hole of said hinge arm, said second oblong hole having opposite-facing rims engaging threads of said threaded section of said joint-adjustment screw.

11. A hinge for an item of furniture having a frame and a door wing, comprising:

a bedplate to be mounted to the frame;

a hinge casing to be mounted to the door wing;

a first intermediate piece carried by said bedplate;

a second intermediate piece carried by said bedplate, said hinge arm being anchored to said second intermediate piece;

a hinge arm carried by said bedplate, said hinge arm being pivotally connected to said hinge casing by a single hinge axle; and a rotatable part mounted on one of said bedplate, said intermediate piece, and said hinge arm, wherein said rotatable part is operable to move said hinge arm relative to said bedplate in a direction parallel to a longitudinal axis of said single hinge axle;

wherein said rotatable part being operable to move said second intermediate piece relative to said first intermediate piece in the direction parallel to the longitudinal axis of said single hinge axle; and wherein said second intermediate piece has angled bars for engaging said bedplate, said angled bars have oblong holes, and guide journals of said bedplate and a pin connecting said bedplate and said second intermediate piece are arranged to project into said oblong holes.

* * * * *